US010690050B2

(12) United States Patent
Cocanougher et al.

(10) Patent No.: US 10,690,050 B2
(45) Date of Patent: Jun. 23, 2020

(54) INTERNAL COMBUSTION ENGINE WITH PAIRED, PARALLEL, OFFSET PISTONS

(71) Applicant: Wise Motor Works, Ltd., North Richland Hills, TX (US)

(72) Inventors: Allen Cocanougher, North Richland Hills, TX (US); Robert Allen Cocanougher, Sr., North Richland Hills, TX (US); Robert Allen Cocanougher, Jr., North Richland Hills, TX (US)

(73) Assignee: Wise Motor Works, Ltd., North Richland Hills, TX (US)

( * ) Notice: Subject to any disclaimer, the term of this patent is extended or adjusted under 35 U.S.C. 154(b) by 0 days.

(21) Appl. No.: 16/448,771

(22) Filed: Jun. 21, 2019

(65) Prior Publication Data

US 2019/0309679 A1 Oct. 10, 2019

Related U.S. Application Data

(63) Continuation of application No. 16/029,737, filed on Jul. 9, 2018, now Pat. No. 10,344,670, which is a continuation of application No. 15/821,138, filed on Nov. 22, 2017, now Pat. No. 10,018,112, which is a (Continued)

(51) Int. Cl.

| | |
|---|---|
| ***F02B 25/08*** | (2006.01) |
| ***F02B 75/18*** | (2006.01) |
| ***F02B 75/22*** | (2006.01) |
| ***F02B 41/00*** | (2006.01) |
| ***F02B 41/06*** | (2006.01) |
| *F02B 75/02* | (2006.01) |

(52) U.S. Cl.

CPC ..... *F02B 75/1896* (2013.01); *F02B 41/00* (2013.01); *F02B 41/06* (2013.01); *F02B 75/225* (2013.01); *F02B 75/228* (2013.01); *F02B 75/02* (2013.01); *F02B 2075/027* (2013.01); *F02B 2075/1808* (2013.01); *Y10T 29/49233* (2015.01)

(58) Field of Classification Search

CPC ..... F02B 33/22; F02B 75/228; F02B 75/1896
USPC ..... 123/27 R, 70 R, 51 A
See application file for complete search history.

(56) References Cited

U.S. PATENT DOCUMENTS

| | | | |
|---|---|---|---|
| 1,135,943 | A | 4/1915 | Logan |
| 1,239,523 | A | 9/1917 | Rogers |
| 1,457,322 | A | 6/1923 | Sproule |

(Continued)

FOREIGN PATENT DOCUMENTS

| | | | |
|---|---|---|---|
| EP | 1312778 | A1 | 5/2003 |
| EP | 1148219 | A3 | 11/2004 |

(Continued)

OTHER PUBLICATIONS

Scott, "Paired-Cylinder Engine—New Route to Stratified Charging?", Popular Science, vol. 212, No. 2, Feb. 1978, 58-60.

*Primary Examiner* — Long T Tran
*Assistant Examiner* — James J Kim
(74) *Attorney, Agent, or Firm* — Vos-IP, LLC

(57) ABSTRACT

An internal combustion engine wherein at least two cylinders continuously communicate via the cylinder head and wherein the connecting rod in one cylinder is offset from the connecting rod in the second cylinder by a first angle between 8 and 12 degrees as measured from the crankshaft, and a camshaft having a second offset of one half of the first angle offset.

17 Claims, 8 Drawing Sheets

Related U.S. Application Data continuation-in-part of application No. 14/282,201, filed on May 20, 2014, now abandoned.

(60) Provisional application No. 61/831,491, filed on Jun. 5, 2013.

(56) References Cited

U.S. PATENT DOCUMENTS

| | | | |
|---|---|---|---|
| 1,790,534 | A | 1/1931 | Chevallier et al. |
| 2,058,705 | A | 10/1936 | Maniscalco |
| 2,234,267 | A | 3/1941 | Mallory |
| 2,415,507 | A | 2/1947 | Mallory |
| 2,988,065 | A | 6/1961 | Wankel et al. |
| 3,537,437 | A | 11/1970 | Paul et al. |
| 3,871,337 | A | 3/1975 | Green et al. |
| 3,911,753 | A | 10/1975 | Daub |
| 4,099,489 | A | 7/1978 | Bradley |
| 4,157,080 | A | 6/1979 | Hill |
| 4,274,369 | A | 6/1981 | Rhoads |
| 4,506,634 | A | 3/1985 | Kerrebrock |
| 4,776,306 | A | 10/1988 | Matsuura et al. |
| 5,758,610 | A | 6/1998 | Park |
| 6,467,440 | B1 | 10/2002 | Kozulin et al. |
| 6,543,225 | B2 | 4/2003 | Scuderi |
| 7,584,724 | B2 | 9/2009 | Berger |
| 7,588,001 | B2 | 9/2009 | Branyon et al. |
| 7,810,459 | B2 | 10/2010 | Branyon et al. |
| 8,347,850 | B2 | 1/2013 | Schenk et al. |
| 8,434,305 | B2 | 5/2013 | Donkin et al. |
| 10,344,670 | B2 * | 7/2019 | Cocanougher ..... F02B 75/225 |
| 2004/0226523 | A1 | 11/2004 | Kreuter et al. |
| 2005/0268609 | A1 | 12/2005 | Branyon et al. |
| 2007/0157894 | A1 | 7/2007 | Scuderi et al. |
| 2010/0147236 | A1 | 6/2010 | Springer |
| 2011/0220076 | A1 | 9/2011 | Meldolesi et al. |
| 2013/0092132 | A1 | 4/2013 | Gabdullin |
| 2015/0315959 | A1 | 11/2015 | Tour et al. |

FOREIGN PATENT DOCUMENTS

| | | | |
|---|---|---|---|
| EP | 1170478 | B1 | 12/2004 |
| EP | 1607594 | A1 | 12/2005 |
| EP | 2088283 | A1 | 8/2009 |
| EP | 1895138 | B1 | 7/2011 |
| WO | WO/2004/027237 | A2 | 4/2004 |
| WO | WO/2005/068812 | A2 | 7/2005 |

* cited by examiner

INTERNAL COMBUSTION ENGINE WITH PAIRED, PARALLEL, OFFSET PISTONS

CROSS-REFERENCE TO RELATED APPLICATIONS

This application is a continuation of U.S. patent application Ser. No. 16/029,737, filed Jul. 9, 2018, which is a continuation of U.S. patent application Ser. No. 15/821,138, filed Nov. 22, 2017, which is a continuation-in-part of U.S. patent application Ser. No. 14/282,201, filed May 20, 2014, which claims priority to U.S. Provisional Patent Application No. 61/831,491, filed Jun. 5, 2013, which are hereby incorporated by reference in their entirety.

FIELD OF INVENTION

The present application is generally related to internal combustion engines. More specifically, the present invention relates to a four-stroke engine having a pair of connecting rods, which are offset at an offset angle as measured from the crankshaft, and a camshaft having an offset of one half of the crankshaft offset angle, and having at least two cylinders that communicate via a common cylinder head.

BACKGROUND OF THE INVENTION

Internal combustion engines are devices in which reactants (e.g., fuel and an oxidizer) are combusted in a combustion chamber to produce high-pressure gas so as to apply force to another component of the engine. The typical components of an internal combustion engine are well known to those of ordinary skill in the art. These components generally include cylinders, pistons, valves, the cylinder head, the crankshaft, the camshaft, and the engine block.

Combustion of the reactants takes place inside a combustion chamber, which is generally formed by the cylinder heads, cylinders, and the tops of the pistons. In spark ignition engines, a spark is used to ignite the reactants. In compression ignition engines, the heat created by compression ignites the reactants. Regardless of how the reactants are ignited, the resulting combustion produces heat and pressure that act on the moving surfaces of the engine, such as the top of the piston. The pistons are generally attached to a crankshaft via connecting rods, which transfer the motion of the pistons into rotational motion.

Most internal combustion engines are four-stroke engines. A four-stroke engine is one in which the piston(s) must complete four movements, or strokes, to produce power. This is also known as the "Otto" cycle. Typically, a four-stroke engine works as follows. During the first stroke, intake, the piston descends, drawing the reactants into the combustion chamber through an inlet valve. The piston continues downward until it reaches the point at which it is farthest from the cylinder head, i.e., bottom dead center. At the start of the second stroke, compression, the inlet valve closes, and the piston moves upward to the point where it is closest to the cylinder head, i.e., top dead center. In the third stroke, power, the compressed reactants are ignited, forcing the piston downward. An outlet valve opens and the piston moves back upward to complete the last stroke, exhaust. The four-stroke cycle is then repeated.

A commonly cited problem with the four-stroke engine is that it operates at only one third efficiency. In other words, only a third of the potential fuel energy is delivered to the crankshaft. Two thirds of the energy are lost either through the exhaust or as waste heat. Thus, due in part to increased fuel efficiency standards, numerous variations have been introduced to improve engine efficiency. See U.S. Pat. Nos. 8,434,305, 8,347,850, 7,810,459, 6,543,225, 4,776,306, 4,099,489, 3,871,337, 2,988,065, 2,058,705, 1,790,534, and 608,845; WO Publications 2005/068812, 2004/027237; EP Publications 1,148,219, 1,170,478, 1,312,778, 1,607,594, 1,895,138, 2,088,283; and David Scott, "Paired-Cylinder Engine," Popular Science February 1978. Each and every reference cited herein is hereby incorporated by reference in its entirety, where appropriate, for teachings of additional or alternative details, features, and/or technical background.

One alternative to the traditional four-cycle engine is the split-cycle engine, in which the four strokes are shared between two cylinders. In a split-cycle engine, the intake and compression strokes take place in one cylinder. The compressed reactants are then transferred to a second cylinder, in which the power and exhaust strokes are performed. Transference between the first and second cylinder typically occurs via a crossover chamber, which is closed off via a valve before ignition in the second cylinder. Outside of split-cycle engines, communication of the reactants between two cylinders is uncommon in engine design.

The Scott article, cited above, describes a pair of pistons connected by a recess in the block face, where the pistons perform separate "mixture-induction" and "air-swirl" functions. However, this design causes additional cost and efficiency problems. For example, while the cylinder head is easily replaceable, the block face is not. One advantage of the current invention is that it can be created from existing engines efficiently and inexpensively by modifying the cylinder head and the crankshaft or connecting rods.

Traditionally, ignition is timed so that combustion occurs near the end of the compression stroke, i.e., slightly before top dead center. This is needed because the reactants do not completely burn at the moment that the spark fires. Thus, by advancing the spark before top dead center, combustion actually occurs when the combustion chamber reaches its minimum size. Generally, sparks occurring after top dead center are thought to be counterproductive, producing excess waste. Only a few small engines are designed to ignite after top dead center.

Knocking is another engine complication that occurs when the reactants are unintentionally combusted at the incorrect moment. Knocking can cause severe engine damage. In a spark ignition engine, the reactants are meant to be ignited only via the spark plug at the precise time of ignition. Knocking, or abnormal combustion, occurs when a pocket of the reactants is detonated outside the boundary of the flame front. Knocking can be caused by preignition, when the reactants ignite before the spark plug fires.

The prior art engines discussed herein are to be considered conventional engines where appropriate.

SUMMARY OF THE INVENTION

An embodiment of the invention comprises a new and improved internal combustion engine comprising a cylinder head, a first and second cylinder, a first and second piston, a first and second connecting rod, and a crank shaft, wherein the first and second cylinder communicate via the cylinder head, which remains open at all times, and wherein the second connecting rod is offset from the first connecting rod at an offset angle between about 8 and 12 degrees.

An internal combustion engine comprising: a cylinder head, a first and second cylinder in parallel orientation, a first and second piston disposed within said first and second cylinders, a first and second connecting rod, a crank shaft, a camshaft, a first fuel injector operative to said first cylinder and a second fuel injector operative to said second cylinder, and a first spark plug open to said cylinder head above said first cylinder, and a second spark plug open to said cylinder head above said second cylinder; wherein a cylinder head defines an upper boundary and creates a cylinder head space opening between the first and second cylinder, wherein the cylinder head space remains open to the first and second cylinders at all times; wherein the second connecting rod is offset from the first connecting rod defining the second piston at a trailing offset angle between about 8 and 12 degrees; and wherein the camshaft is defined to be offset at one half of the trailing angle of the second piston, defined between 4 and 6 degrees; and wherein second fuel injector injects fuel into said second cylinder and wherein said first and second spark plugs ignite after the first piston is at top dead center, thereby forcing the pistons to reciprocate within said first and second cylinders and wherein said first and second pistons maintain said offset angle while said pistons are reciprocating having the second piston trailing the first piston.

A method of modifying a conventional engine comprising the following steps: modifying or replacing a cylinder head to allow for at least two parallel cylinders to have a shared head space, by connecting the cylinders via a cylinder head space disposed of above the top of the cylinders and below the cylinder head; and modifying or replacing at least one crankshaft such that a first and second connecting rod is connected to a first piston and a second piston disposed of in said first and second cylinders, wherein said second connecting rod and said crankshaft defining an offset angle where the second piston is trailing the first piston by about 8 and 12 degrees, and modifying or replacing a camshaft having an offset angle of one half of the offset of the crankshaft, where the second cylinder is trailing the first cylinder by between 4 and 6 degrees.

A system for modifying a standard engine comprising a replacement head having disposed of openings situated between a pair of cylinders on said standard engine, creating a cylinder head space between said pair of cylinders; and further comprising at least one replacement crankshaft having a first connecting rod to a first piston and a second connecting rod to a second piston, said second connecting rod oriented to be trailing the first by between 8 and 12 degrees, wherein said connecting rods and crankshaft situates said pair of cylinders such that the pistons within said pair of cylinders is defined to have the second piston trailing the first and offset by between about 8 and 12 degrees; and a replacement camshaft, having a trailing offset in the second cylinder, with said offset defined at one half of the offset of the crankshaft, thus between 4 and 6 degrees.

An internal combustion engine comprising: a first leading cylinder and second trailing cylinder having fluid passage between one another in a head opening, a cylinder head, a first and second piston, a first and second connecting rod, a crankshaft, a camshaft, at least two exhaust valves, at least two intake valves, at least one spark plug, and a fuel injection component; wherein the first and second cylinders communicate via the head opening space defined between the cylinder and the cylinder head; wherein the head opening remains open to the first and second cylinders at all times; wherein the second piston is a trailing piston and offset in the second cylinder by between an 8 and 12 degree crank angle; wherein the camshaft is engaged to the at least two exhaust valves and at least two intake valves, and said camshaft is offset by one half of the crank angle in the second cylinder; and wherein fuel is provided via the fuel injection component only to the trailing cylinder, between 3500 and 5000 revolutions per minute, when the engine is running.

An internal combustion engine comprising at least two pairs of cylinders, an equal number of pistons as they are cylinders, a first and second connecting rod, a crankshaft, a camshaft, at least two exhaust valves, at least two intake valves, at least one spark plug, and a fuel injection component: in a first cylinder pair, a cylinder head connecting a first leading cylinder and a first trailing cylinder and having fluid passage between one another in a head opening, a first piston within said first leading cylinder and a second piston with said first trailing cylinder; wherein the first leading cylinder and said first trailing cylinder communicate via the head opening space defined between the cylinder and the cylinder head; wherein the head opening remains open to the first and second cylinders at all times; wherein the second piston is a trailing piston and offset in the second cylinder by between an 8 and 12 degree crank angle from said first piston; and wherein the camshaft is engaged to the at least two exhaust valves and at least two intake valves, and said camshaft is offset by one half of the crank angle between the first and second pistons.

In a preferred embodiment, the internal combustion engine has an offset angle of the crankshaft is 12 degrees and the offset angle of the camshaft is 6 degrees.

In a preferred embodiment, the internal combustion engine has an offset angle of the crankshaft is 8 degrees and the offset angle of the camshaft is 4 degrees.

In a preferred embodiment, the internal combustion engine has combustion occurring via compression or via ignition combustion.

In a preferred embodiment, the internal combustion engine provides ignition to both the first and second cylinder.

In a preferred embodiment, the internal combustion engine begins ignition when the first (leading) piston is at top dead center. In other embodiments, ignition occurs when the first piston is after top dead center.

In a preferred embodiment, the internal combustion engine wherein the exhaust fuel to air ratio is greater than 17:1 between 3500 and 5000 RPM.

In a preferred embodiment, a method of modifying a conventional engine comprising the following steps: modifying or replacing a cylinder head to allow for at least a first leading cylinder and a second trailing cylinder to communicate by connecting the cylinders via an opening disposed of above the top of the cylinders and below the cylinder head; modifying or replacing a crankshaft of said engine such that at least a connecting rod, connected to said crankshaft, is connected to a first piston in said first leading cylinder, and at least a second trailing piston that is disposed of in said trailing cylinder and is offset from said leading cylinder by an offset angle of between about 8 to about 12 degrees; and modifying or replacing at least one camshaft having an offset of one half of the offset of the crankshaft, such that the offset corresponds to the second trailing cylinder; and, at least one fuel injector, wherein fuel is disposed of only in said trailing cylinder while the engine is running at between 3500 and 5000 RPM.

In a preferred embodiment, a method of increasing the efficiency of a four-cycle engine comprising: modifying said engine, said engine comprising a first leading cylinder and second trailing cylinder, having fluid passage between one another in a head opening, a cylinder head, a first and second piston, a first and second connecting rod, a crankshaft, a camshaft, at least two exhaust valves, at least two intake valves, at least one spark plug, and a fuel injection component; wherein the first and second cylinder communicate said fluid passage within the head opening space between a top of the cylinder and a bottom of the cylinder head; wherein the head opening remains open to the first and second cylinders at all times; wherein the second piston is a trailing piston and offset in the second cylinder by between 8 and 12 degree crank angle; wherein the camshaft is engaged to the at least two exhaust valves and at least two intake valves, and said camshaft is offset by one half of the crank angle in the second cylinder; and injecting fuel into said second cylinder wherein fuel is provided only to the trailing cylinder when said engine is rotating at between 3500 and 5000 revolutions per minute; and wherein a sparkplug is igniting in both the first and second cylinders despite fuel being provided only into said second cylinder.

DETAILED DESCRIPTION OF THE INVENTION

The embodiments of the invention and the various features and advantages thereto are more fully explained with references to the nonlimiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the claims.

As used herein, terms such as "a," "an," and "the" include singular and plural referents unless the context clearly demands otherwise.

As used herein, the term "about" means within 10% of a stated number.

FIGS. 1-4 depict a first example of rocker cams, e.g. 30 and 31, which contact the camshaft 11 to move the exhaust and intake valves. By contrast, FIGS. 5-8 depict push rods, connected to the camshaft 11. Those of skill in the art will recognize that the type of camshaft 11 can be modified to meet the needs of the particular engine. Indeed, double overhead cams may be utilized, each controlling exhaust of intake valves independently. Other suitable mechanisms exist in the art. The FIGS. 5-8 particularly show the offset nature of the camshaft 11, as will be described in detail throughout. An Otto cycle would proceed with the following FIGS. in order, 1-8, and then repeating.

In each figure, the large circles at the bottom represent the crankshaft 10, which is shown oriented to depict the offset nature of the connecting rods. The two circles are a single crankshaft, simply rotated 90 degrees to depict the offset nature. Similarly, FIGS. 5-8 are showing smaller circles at the top, representing a single camshaft 11 rotated to show the pushrods offset. These representations are understood by those of skill in the art.

Figure 1:
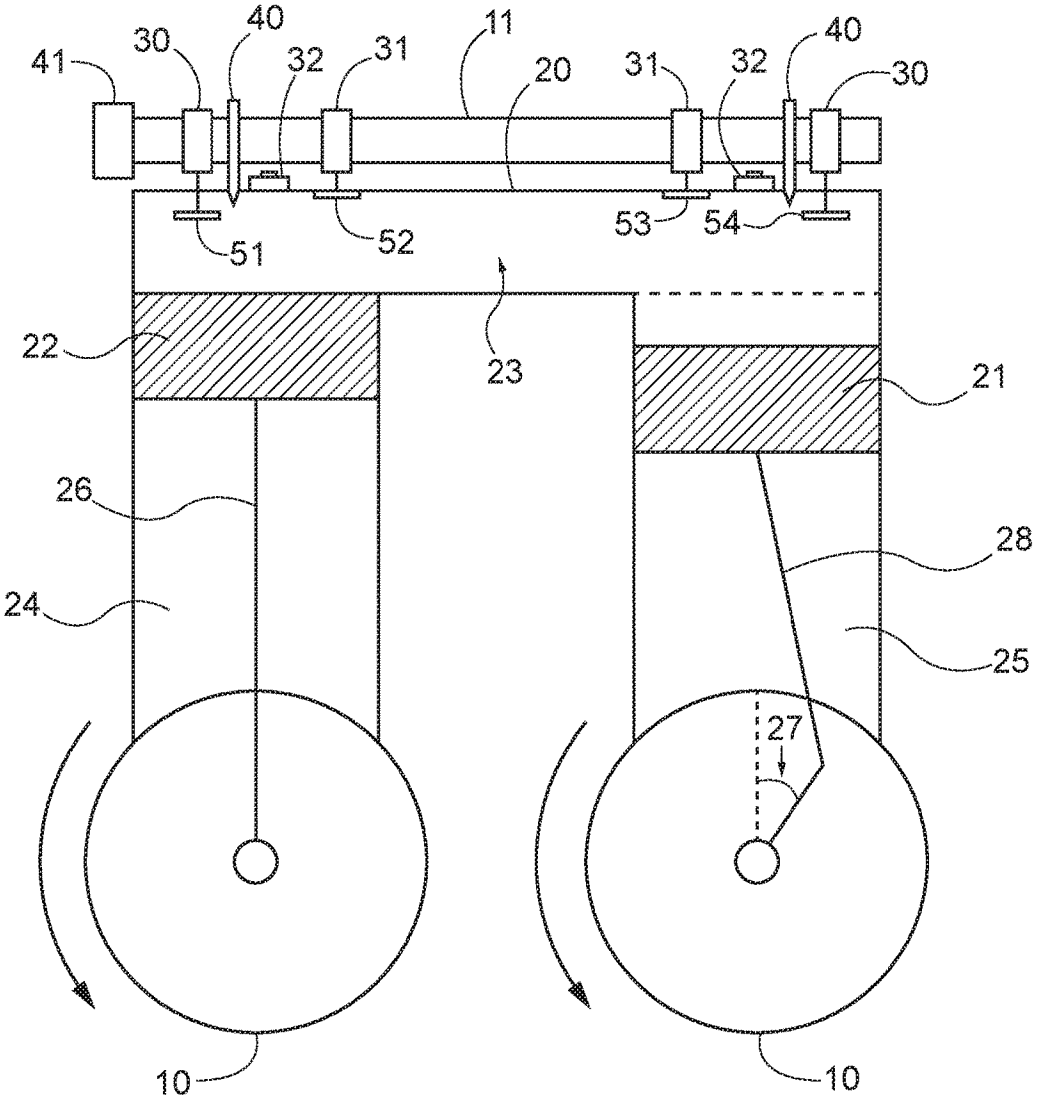
FIG. 1 is a simplified schematic diagram of one embodiment of the invention described herein at the beginning of the intake stroke.

FIG. 1 is a simplified schematic diagram of one embodiment of the invention described herein at approximately the beginning of the intake stroke. The left piston 22 is located at approximately top dead center of the left cylinder 24, which is the point closest to the cylinder head 20. Thus, the left connecting rod 26 is approximately vertical.

The right piston 21 is offset from the left piston 22 and is trailing. When the left piston 22 is at top dead center, the angle 27 of offset of the right piston 21, as measured from where the right connecting rod 28 meets the crankshaft 10, is between about 8 and 12 degrees trailing of the right connecting rod 26. Timing of an engine is often described in degrees, and the timing of certain components is thus described in degrees corresponding to the timing. Here, the parallel pistons 22 and 21 and in fluid communication with one another because of the open head space 23, and the trailing piston 21 is offset by between 8 to 12 degrees. In other words, the connecting rods to the crank shaft enable the trailing piston 21 to be offset from the leading piston 22 by about 8-12 degrees. Thus, the right connecting rod 28 is not completely vertical and the right piston 21 is before dead center in the right cylinder 25. The trailing piston will always be the second piston, which impacts the fuel added to the relative cylinders and the timing and firing of the sparkplugs 32.

Indeed, as depicted, the left (leading) piston 22 and right (trailing) piston 21 are operated together in a single cavity, such that the space in the head opening 23 connects the two cylinders 24 and 25. This head opening 23 is defined between the top of the cylinder and the bottom of the cylinder head and provides that the intake, compression, power, and exhaust is occurring within the two cylinders, because of their fluid communication in this head opening 23—as compared to a typical engine, where each cylinder operates independent of other cylinders. One advantage of the system is that where a typical engine fires before top dead center, a portion of the force on the cylinder is wasted and results in inefficiencies. By pairing the two pistons/cylinders, a single explosion within the two cylinders will begin to affect at least one of the pistons as it is past top dead center, therefore allowing the full force of the explosion to push that piston, where the trailing piston is then pulled past top dead center, and then continues to push down due to the explosion.

Figure 2:
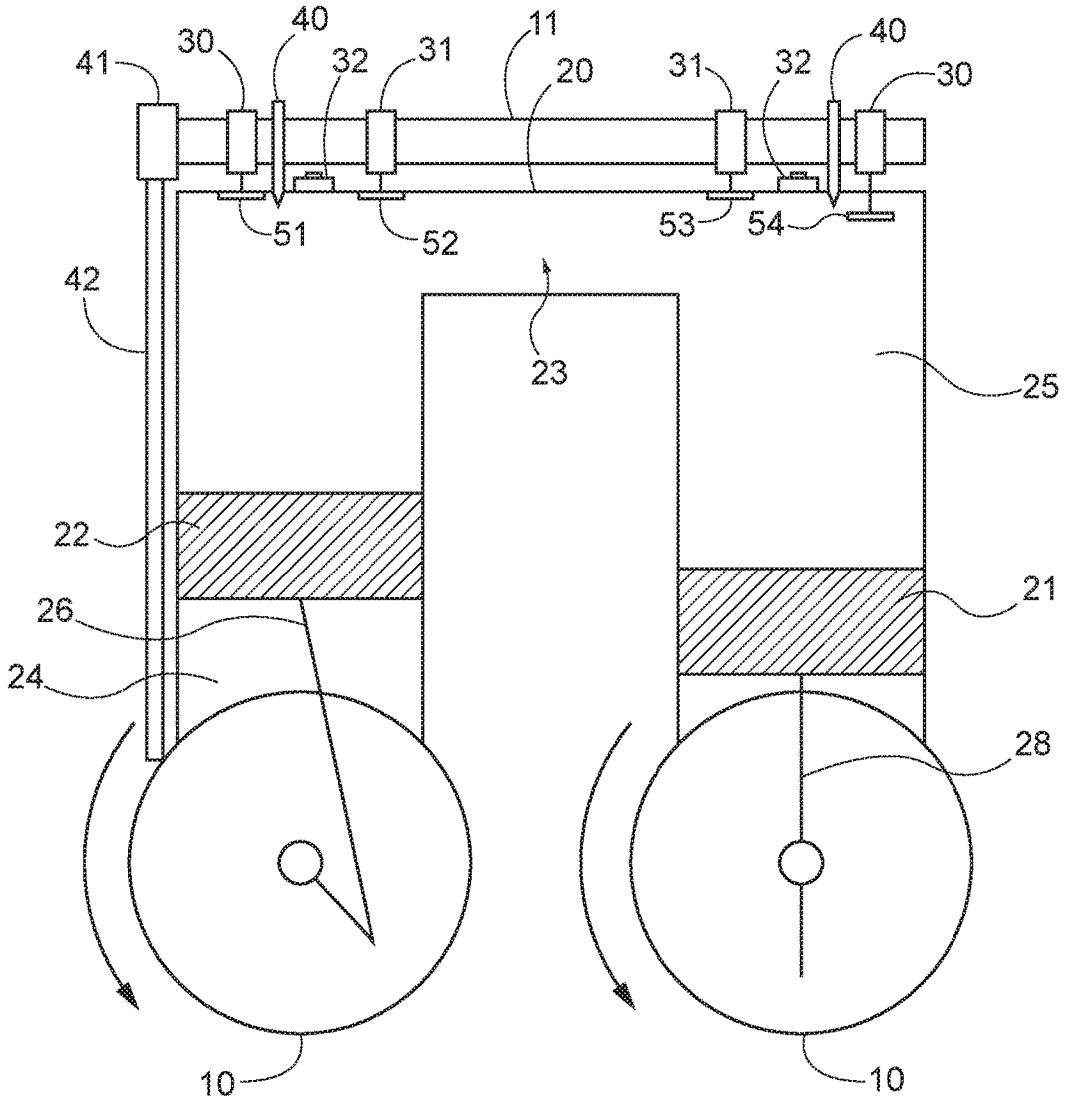
FIG. 2 is a simplified schematic diagram of one embodiment of the invention described herein at the end of the intake stroke.
Figure 3:
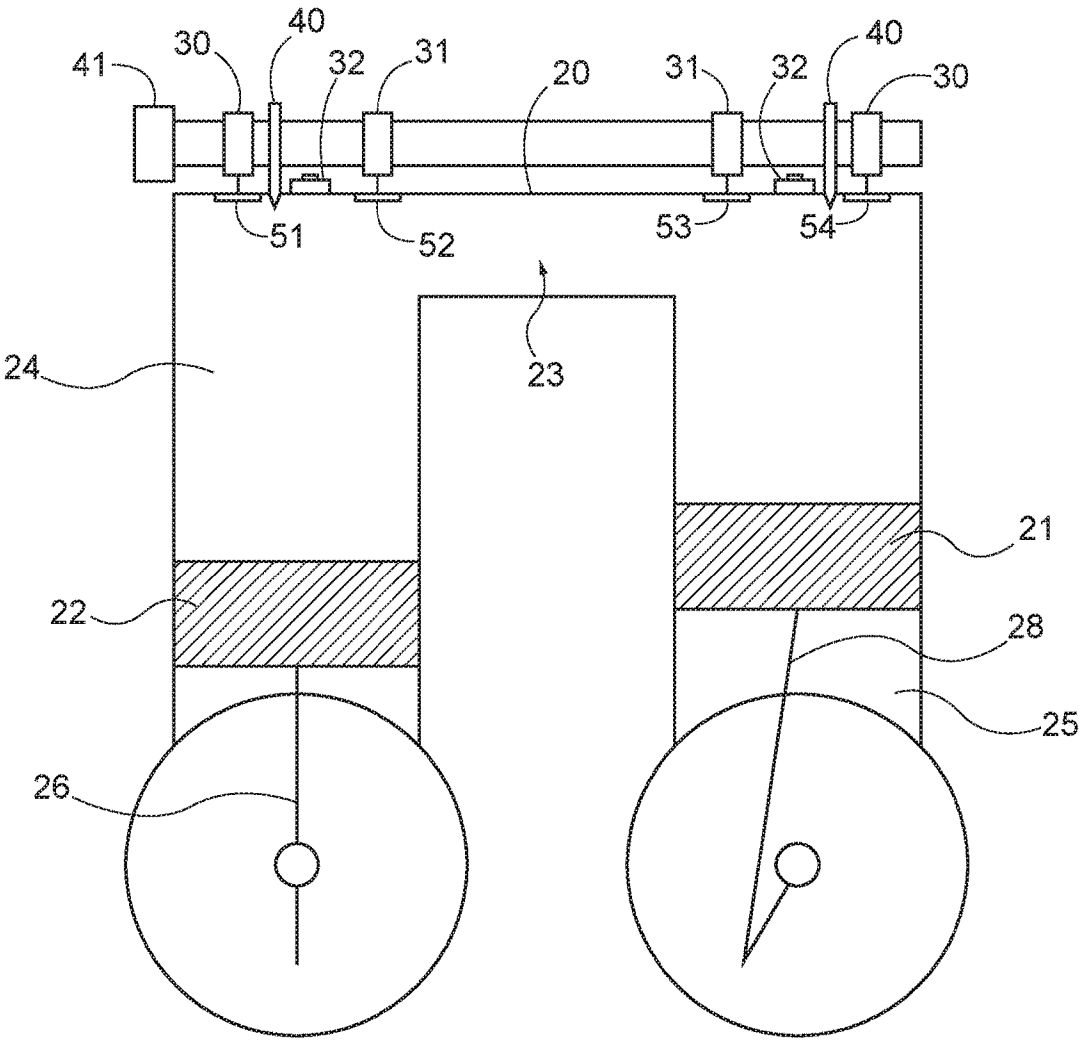
FIG. 3 is a simplified schematic diagram of one embodiment of the invention described herein at the beginning of the compression stroke.

Furthermore, the pushing, and pulling of gas and fuel is greatly improved by the offset nature. For example, as the intake stroke continues, into the compression stroke, as seen in FIGS. 1-4, air enters both the left cylinder 24 and the right cylinder 26, through the intake valves 51 and 54. The small head space 23, then moves gasses between each cylinder as the pistons rotate. As piston 21 pushes up, gas is pushed into the head space 23 and into cylinder 24, as piston 22 rotates down towards bottom dead center. In FIG. 3, as the valves close, and as piston 22 begins to move up, gasses move from cylinder 24 through the open head space 23, into cylinder 25. Gas and air injected into the open head space 23 during the intake and/or compression will then mix with air and increase the burn rate of the air/fuel mixture. While a ratio of 14.7:1 is typical for a stoichiometric air to fuel ratio, we can improve that ratio dramatically and run the engine leaner through this advancement of the engine described herein. For example, we can run the engine at a ratio of 17:1 or higher between 3500 and 5000 RPM, which is not possible with a conventional engine. This allows for a much leaner ratio and results in significant engine fuel efficiency.

As further defined in FIG. 1, the first cylinder 24, and the first piston 22 is positioned at or about top dead center and the second piston 21 within the second cylinder 25 is positioned just shy of top dead center, having a trailing angle or about 8 to 12 degrees. A spark plug 32 is positioned at a central position above each of the cylinders. Importantly, an intake valve 51 and 54 and exhaust valves 52 and 53 are positioned above each cylinder and controlled by the cam shafts. For example, the cam gear 41 rotating, will press the rocker cams or other cam device to move the valves. For example the rocker cam 30 and 31 on each cylinder. A fuel injector 40 is also positioned, adjacent to the spark plug 32, for direct injection into the head space 23.

The cams 30 and 31 are necessary components to allow for the four strokes, the intake, compression, power, and exhaust strokes, by moving the relevant valves 51-54 to allow for air to enter, on the intake, close for compression, close for power, and then exhaust after the power stroke. These valves work with a camshaft 11 that has an appropriate offset in view of the offset of the crankshaft 10. The camshaft 11 rotates at one half the speed of the crankshaft 10. However, to properly operate, the camshaft 11 must also have an offset for the second cylinder 25 at a rate of one half the offset of the crankshaft 10. For example, a crankshaft 10 having an offset of 8 degrees would have a camshaft offset of 4 degrees for the second cylinder. This would then retard the opening and closing of valves 53 and 54 by 4 degrees as compared to valves 51 and 52.

TABLE 1

| Crankshaft Offset | Camshaft Offset |
|---|---|
| 8 | 4 |
| 9 | 4.5 |
| 10 | 5 |
| 11 | 5.5 |
| 12 | 6 |

Table 1 depicts the range of crankshaft offset suitable for the production engine and the corresponding camshaft offset.

The angle of offset between the two pistons will depend on the size of the engine, the RPMs obtained, and other features known to one of ordinary skill in the art. In the embodiment of FIG. 1, when the force from the explosion is applied to the pistons, the left piston 22 is at a mechanically superior position as compared to the right piston 21. This allows the force being applied to the right piston 21 to be mechanically efficient improves the mechanical efficiency as applied in total to the paired pistons, as compared to two individual pistons. By allowing one piston to always be past top dead center when firing, the combined mechanical efficiency is improved. However, to maintain the proper firing and compression the angle must not be too small, nor too large. A larger offset angle of greater than 12 degrees resulted in a reduction in head pressure, and thus the engine ran inefficiently. By contrast, a smaller offset, we believe, did not allow for sufficient mixture of fuel and air, and also reduced the head pressure, as compared to individual cylinders, and thus was also less efficient than those between about 8 and 12 degrees offset. This range was surprising in the significant gains seen in fuel efficiency, as crankshafts of less than 8 degrees when tested ran similar to a single engine for efficiency, just with less power because of the reduced head pressure. Similarly, the larger angle ran even less efficiently than the standard engine in both power and in fuel efficiency due to the lag of the second piston and also due to the much larger volume at spark, thus reducing the compression and head pressure. Thus, the 8-12 degree range, and specifically 12 degrees was surprisingly superior.

By adjusting the offset angle 27, the compression in the head opening 23 can be modified to maximize performance of the engine. Similarly, the amount of space in the head opening 23 can be modified to enlarge or minimize the opening space to modify the amount of possible compression and to allow for optimal gas exchange between the two cylinders. However, at no time is the head opening 23 closed; therefore, the two cylinders/pistons are always connected via this head opening 23 space. For example, the cylinder head 20 can be machined to have a single tube for gas exchange, or a larger groove. In each case, the space should not restrict flow to allow for the efficient exchange of gasses in each piston, while the smaller size allows for increased head pressure.

Generally, a functioning engine would comprise a single pair of cylinders, or, alternatively, two, three, or four pairs, or more pairs of cylinders to maintain balance. The additional cylinders may be oriented in-line, or offset in any of the orientations known of one of skill in the art. For conventional engines for typical use in recreational vehicles, or for other small scale uses, the typical engine will have one or two pairs of cylinders.

It would be feasible to take a straight 8 cylinder, or an angled 8 cylinder engine and modify various components of the engine, i.e. the cylinder head 20, so as to introduce a head opening 23, as between the previously unconnected cylinders. With additional modifications to the connecting rods 26 and 28 and other features of the engine to form the offset paired cylinders. Indeed, by having an engine with 8 cylinders, each of the four pairs could be starting one of the four cycles of the Otto cycle, as a mechanism to balance the engine and optimize the efficiency.

Similarly, a four cylinder engine could have one pair beginning the firing cycle and the other beginning the intake cycle. Alternatively, it may be advantageous to have each pair offset as to another pair of cylinders.

This design of this embodiment differs significantly from other designs in which two pistons are pushed from a single explosion via the opposing cylinder engine. There, the pistons fire in opposing directions. Here, the cylinders are intended to be substantially parallel to one another, but the pistons within the cylinders are offset. That allows for the modification in the head to allow for the connection of the two cylinders. The design herein provides for a significant advantage in operating efficiency as compared to prior art engines.

The engine cycle is appropriately detailed through FIGS. 1-8. The relative positions of each of the pistons and of the valves are illustrative to describe the features, and their specific positions may be modified as appropriate. The specific location can also be modified based on timing, RPMs of the engine, etc., to control the power and fuel efficiency.

Figure 6:
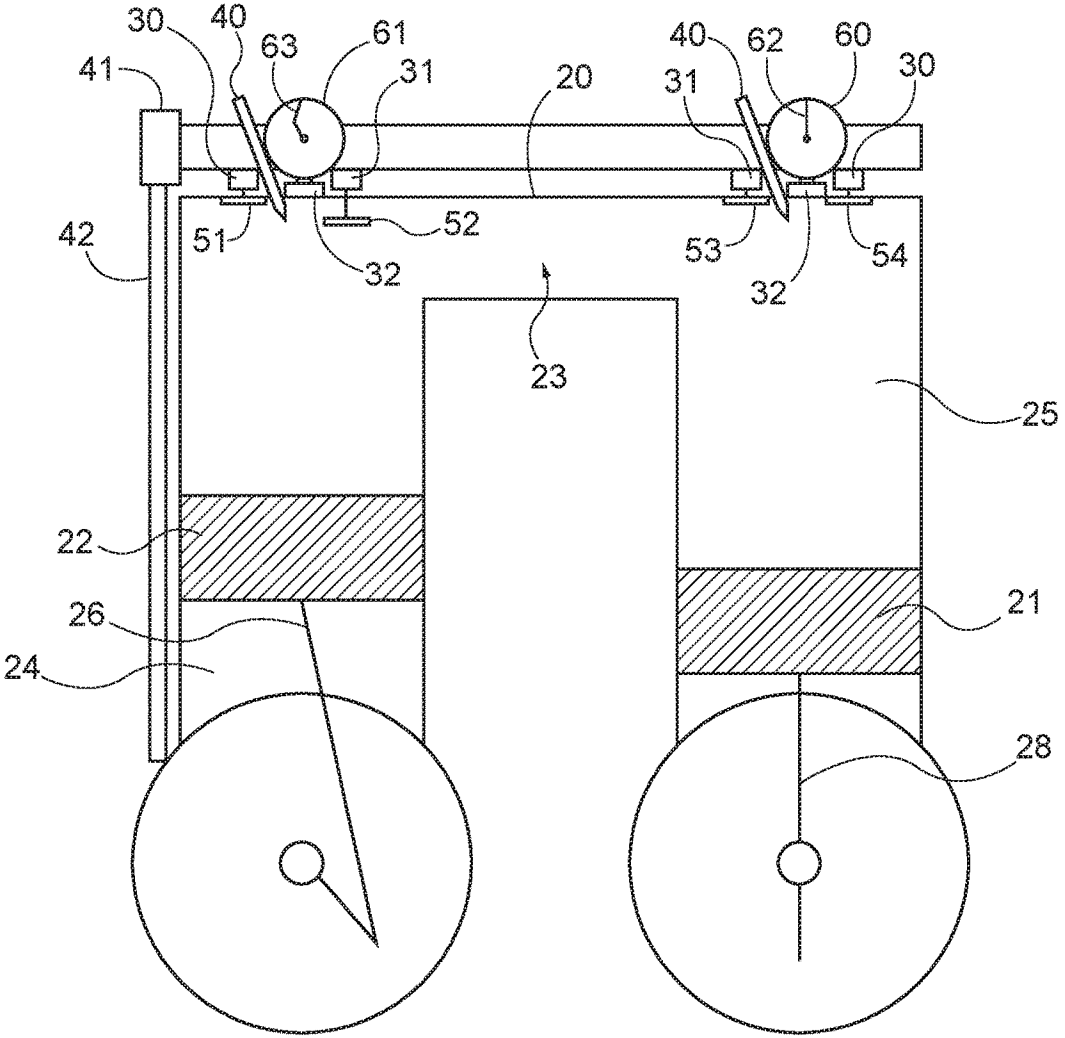
FIG. 6 is a simplified schematic diagram of one embodiment of the invention described herein at the end of the power stroke.
Figure 7:
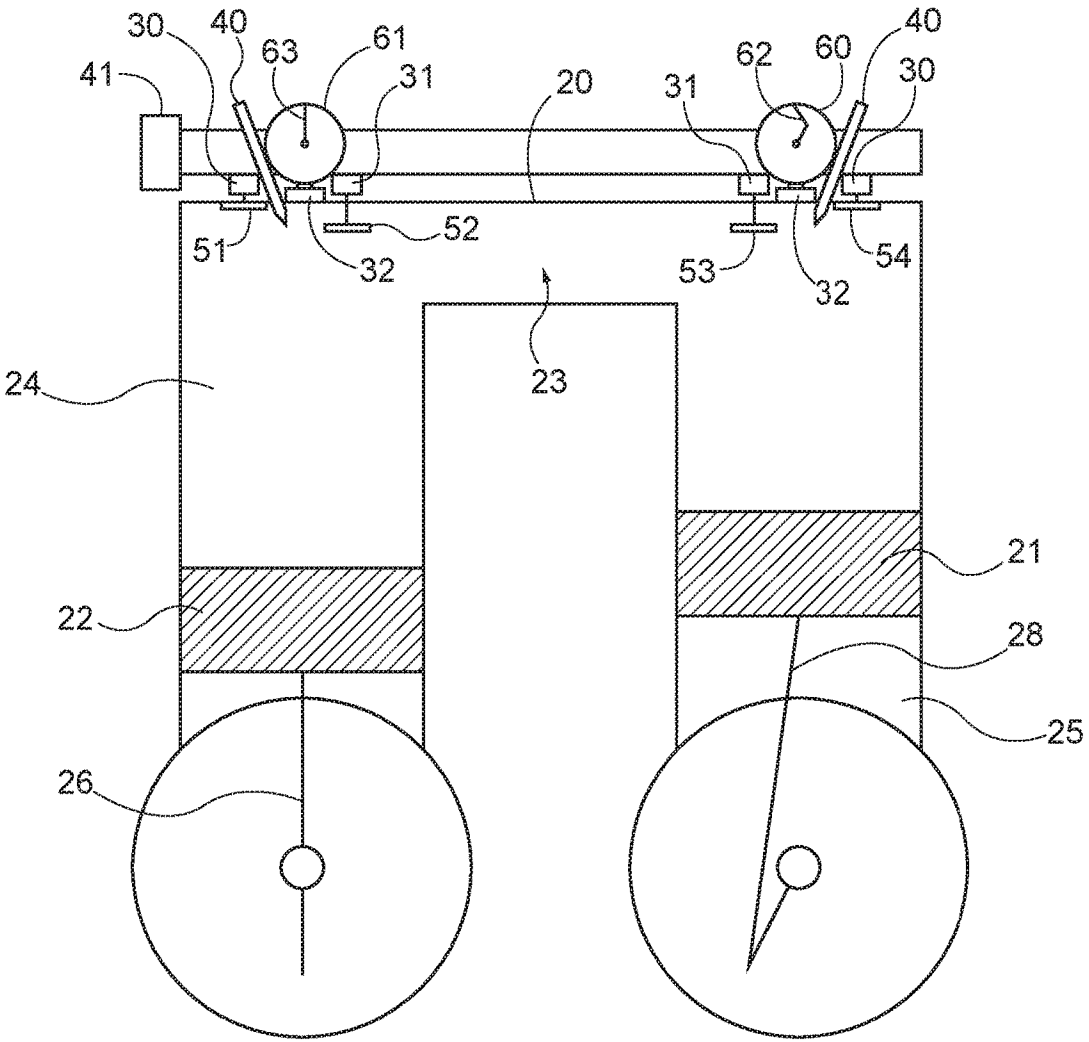
FIG. 7 is a simplified schematic diagram of one embodiment of the invention described herein at the beginning of the exhaust stroke.

FIG. 1 specifically starts the beginning of the intake portion of the cycle. The left piston 22 is at top dead center and the intake valves 51 and 54 are open, to allow for air to enter the cylinders 24 and 25 as the crankshaft 10 rotates in a counterclockwise manner and pulls the left piston 22 down, with the right piston 21 following. At FIG. 2, the end of the intake stroke, the right piston 21 is at bottom dead center. The intake and exhaust valves are depicted with intake 51 closed, while intake 54 is nearly closed, being that it is trailing/offset by about 6 degrees for a 12-degree offset crankshaft. On the left side of FIG. 2, is a belt 42. The belt may be any ordinary belt used in engines, the belt 42 connects the crankshaft 10 to the camshaft 11. FIG. 6 also shows this belt 42; it is otherwise omitted from other figures for clarity of the other components within the cycle, though it would be present in all cases.

FIG. 3 depicts the beginning of the compression stroke, where the left piston 22 is at approximately bottom dead center and the trailing piston 21 is nearly at bottom dead center. All valves 51-54 are closed, to allow for compression of the air within the cylinders. As the crankshaft 10 rotates, air is compressed and pushes first from the smaller volume in cylinder 24, through the open head space 23 and into the greater relative volume of cylinder 25. At the same time, or even starting in the intake portion of FIGS. 1 and 2, fuel is injected into only the second cylinder 25, under routine function. The table below provides for data regarding the precise firing and fuel injection into these cylinders and the relevant efficiencies.

TABLE 2

| Test Number | Cylinder | Ignition On/Off | Fuel On/Off | Air On/Off | Air/Fuel Ratio | Exhaust Air/Fuel Ratio |
|---|---|---|---|---|---|---|
| 1 | 1 | On | On | On | 13.5:1 | 10:1 |
| | 2 | On | On | On | 13.5:1 | |
| 2 | 1 | On | Off | On | Air Only | 18:1 |
| | 2 | On | On | On | 13.5:1 | |
| 3 | 1 | Off | On | On | 13.5:1 | 17:1 |
| | 2 | On | On | On | 13.5:1 | |
| 4 | 1 | On | On | On | 13.5:1 | Will Not |
| | 2 | On | Off | On | Air Only | Run |
| 5 | 1 | On | Off | On | 13.5:1 | 17:1 |
| | 2 | On | On | On | 13.5:1 | |

Test 5 repeated Test 2, with modified timing, both advanced and retarded—and resulted in a reduction in the efficiency, from optimal timing. Accordingly, the optimal operating procedure is defined by Test 2, which indicates that no fuel is provided to the leading cylinder, i.e. cylinder 24 or the left cylinder in the images. Thus, all fuel is provided to the cylinder 25 having the trailing piston 21. Interestingly, if you swap the fuel, and have only fuel to the leading cylinder 24, the engine stalls and will not run as shown in Test 4 in the above table. Yet fuel to both chambers has the engine running rich and thus wastes fuel. This surprising effect of fuel injection to only the trailing cylinder leads to some of the increased fuel efficiency we see in this engine.

Figure 4:
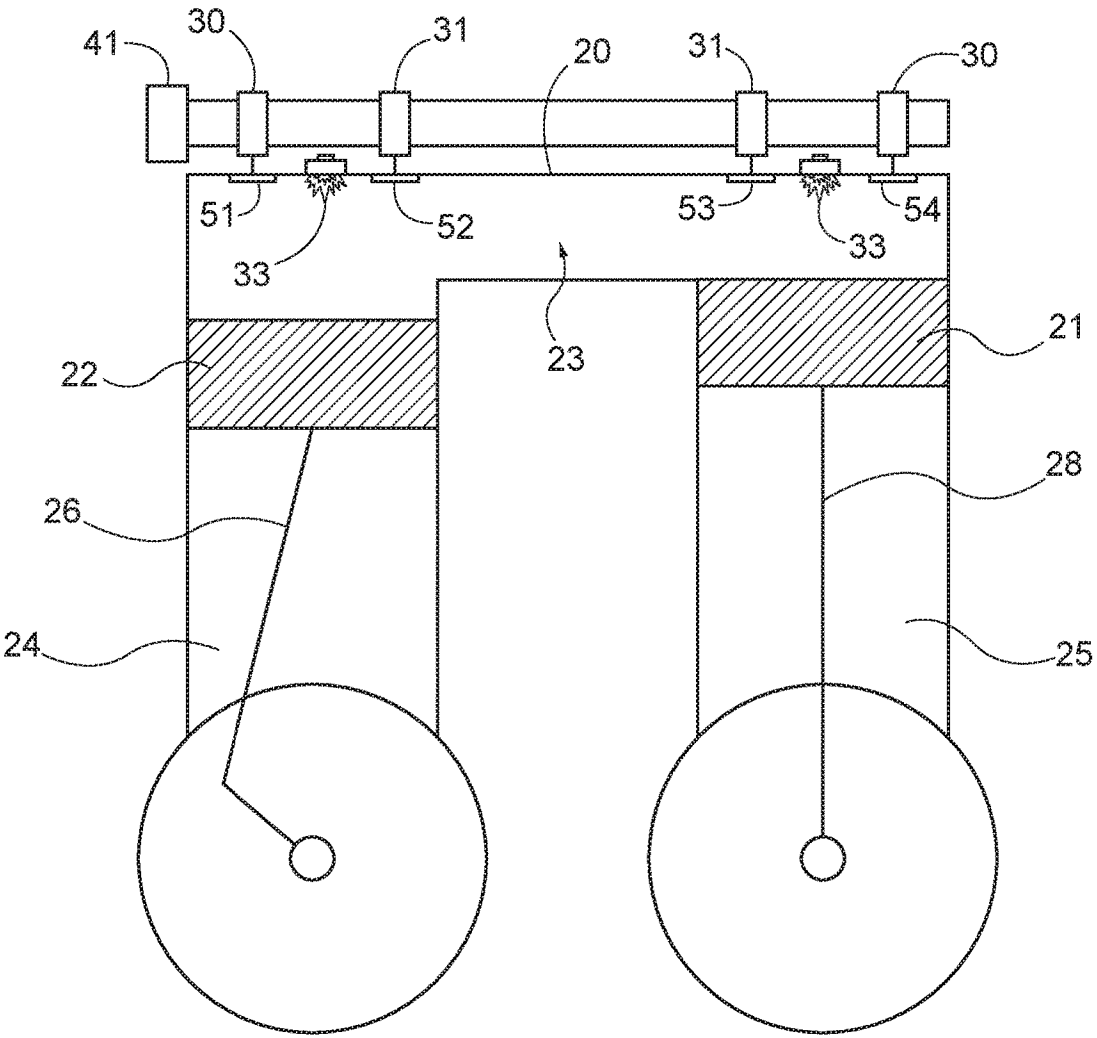
FIG. 4 is a simplified schematic diagram of one embodiment of the invention described herein at the end of the compression stroke.
Figure 5:
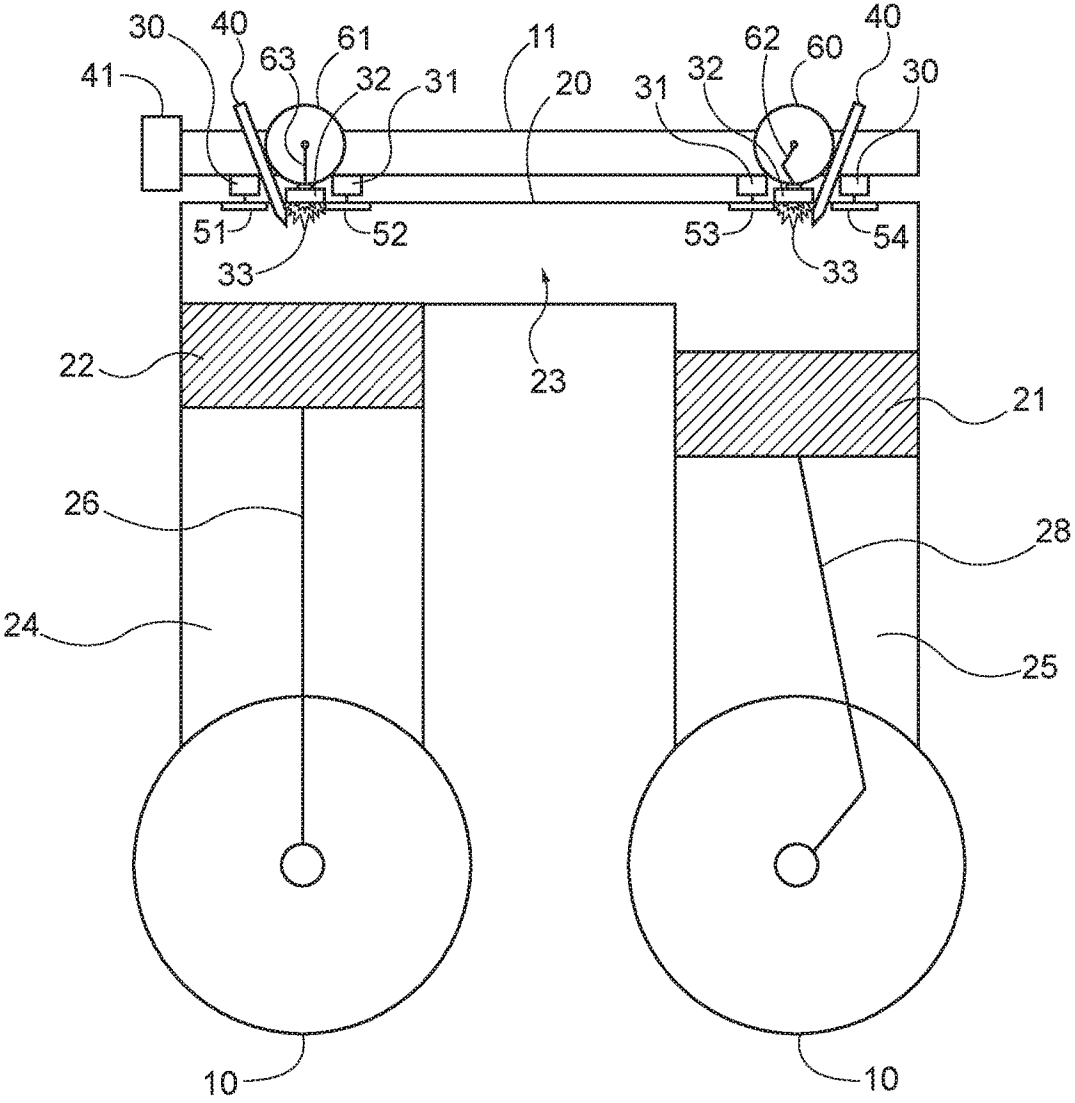
FIG. 5 is a simplified schematic diagram of one embodiment of the invention described herein at the beginning of the power stroke.

At the end of the compression stroke and beginning of the power stroke, e.g. FIGS. 4 and 5, a spark 33 is generated in each cylinder. This is provided with fuel into the second cylinder 25 only. The spark 33 is engaged based on optimal timing of the engine, typically as the left piston 22 has reached top dead center. This allows for the spark to ignite the air/fuel mixture in the compressed chamber and push the left piston 22 down, as the right piston 21 reaches top dead center, and follows completing the cycle. As we approach FIG. 6 and FIG. 7, the power cycle ends and the exhaust cycle starts. In FIG. 6, the exhaust valve 52 begins to open before the exhaust valve 53, while in FIG. 7, both exhaust valves 52 and 53 are open. Again, this is based on the slight offset timing from the cam shaft, and the air and exhaust aid in the flow of gasses within the head space 23 to increase the efficiency of this engine.

Figure 8:
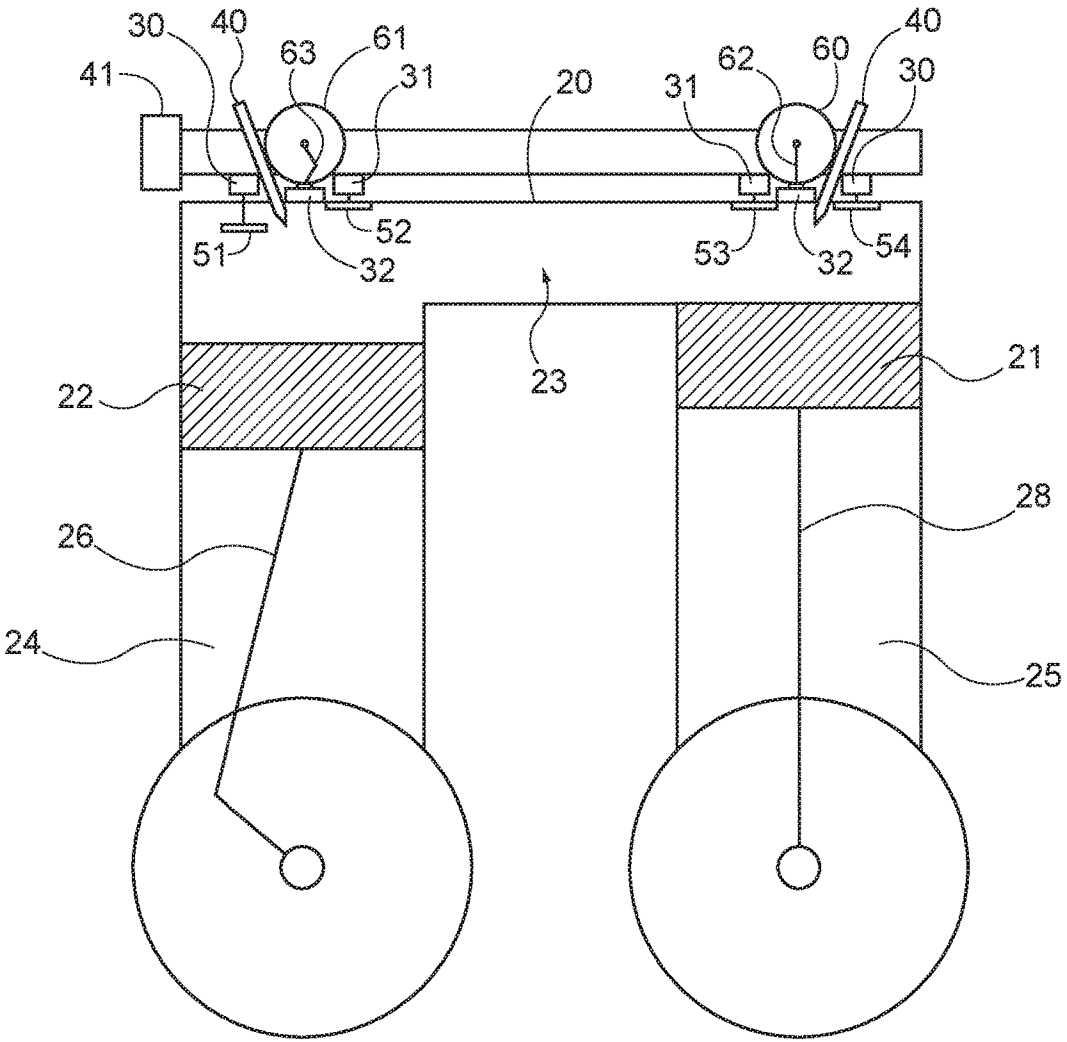
FIG. 8 is a simplified schematic diagram of one embodiment of the invention described herein at the end of the exhaust stroke.

Finally, as in FIG. 8, the exhaust ends and the intake cycle again beings, with the intake valve 51 opening first, as air is pulled into the cylinder. In certain embodiments, and based on timing, both an exhaust valve and an intake valve may be open simultaneously, or the intake open above one cylinder, while the exhaust is open above the opposing cylinder. The relative timing of the valves 51-54 is illustrative, and each may open earlier or later as defined by electronic control systems, and variable timing systems. Accordingly, their precise nature may be different between one Figure over another. However, their relative positions as depicted and described are understood by those of skill in the art, with the primary feature being that the camshaft 11 is offset by one half of the offset of the crankshaft to allow for functioning of the parallel paired pistons.

As defined in more detail in FIGS. 5-8, the cam gear 41 is connected to the camshaft 11 to allow it to rotate with the crankshaft 10, for example with the belt 42. The cam gear 41 is indicated by additional shaft components 61 and 62, allowing for direct connection to push rods, or rotatable contact with valve assemblies to move the valves 51-54. These, as described above, are merely exemplary of the camshaft and its rotation, to show the offset nature of the trailing section, i.e. 62 trailing 61 by a few degrees, based upon the amount of degree separation for the crankshaft.

The push rods, e.g. 62 and 63 would connect to one or more feature of the camshaft and to the valve assemblies, to open and close the valves 51-54. In certain embodiments, it may be advantageous to use a crankshaft or features that are irregular shaped, so that as they turn, a point or a flat section will push onto the cams to open or close valves. Those of skill in the art will recognize the modifications necessary to enable timing for the particular engine.

The below tests utilized an engine having an offset crankshaft of 12 degrees and an offset camshaft of 6 degrees for the trailing cylinder. Based on the earlier test, we recognize that it is advantageous to not include fuel in the first cylinder. However, even fuel in the first cylinder was tested below for relative comparisons. Tests 2 and 3 tested the difference with ignition and no ignition in the first cylinder. Test 4 concluded that the engine would not run with no fuel in the second cylinder. Test 5 tested two further variations of Test 2, advancing timing 7 further degrees of firing of the spark. Test 6 is a standard engine of the same variety, having no parallel cylinders. Each engine orientations were tested at 3500, 4000, 4500, and 5000 RPM as provided in as below in Table 3.

TABLE 3

| Test Number | Cylinder | Ignition On/Off | Fuel On/Off | Air fuel ratio 3500 RPM | 4000 RPM | 4500 RPM | 5000 RPM |
|---|---|---|---|---|---|---|---|
| 1 | 1 | On | On | 10:1 | 10:1 | 10:1 | 10:1 |
| | 2 | On | On | | | | |
| 2 | 1 | On | Off | 18.1:1 | 17.7:1 | 17.7:1 | 17.9:1 |
| | 2 | On | On | | | | |
| 3 | 1 | Off | Off | 17.7:1 | 17.7:1 | 18:1 | 17.9:1 |
| | 2 | On | On | | | | |
| 4 | 1 | On | On | None | None | None | None |
| | 2 | On | Off | | | | |
| 5 | 1 | On | Off | Advanced | N/A | 17.5:1 | 17.5:1 |
| | 2 | On | On | 7° | | | |
| | 1 | On | Off | Advanced | N/A | 14.9:1 | 17.6:1 |
| | 2 | On | On | 15° | | | |
| 6 | Standard engine | — | — | 14.1:1 | 13.9:1 | 13.8:1 | 13.7:1 |

Accordingly, the engines of Tests 2 and 3 are the leanest running engines and thus are optimized. This allows greater fuel efficiency over a standard engine of the same build and would lead to dramatic gains in fuel economy. This is particularly surprising, that small modifications in the orientation as well as in the mixture of fuel into only the trailing cylinder would result in such dramatic improvements in fuel economy over a standard engine. There is a slight exchange in the fuel economy for HP. For example, the engine of Tests 2 and 3 above ran at about a 20% reduction of horsepower as compared to the standard engine. However, most engines do not need the additional power, and most engines typically run nowhere near their maximum RPMs.

TABLE 4

| Test Number | Cylinder | Ignition On/Off | Fuel On/Off | BSFC lbs./HP-Hour 3500 RPM | 4000 RPM | 4500 RPM | 5000 RPM |
|---|---|---|---|---|---|---|---|
| 1 | 1 | On | On | 1.37 | 1.42 | 1.40 | 1.35 |
| | 2 | On | On | | | | |
| 2 | 1 | On | Off | 0.88 | 0.98 | 0.81 | 0.80 |
| | 2 | On | On | | | | |
| 3 | 1 | Off | Off | 1.2 | 0.90 | 0.86 | 0.87 |
| | 2 | On | On | | | | |
| 4 | 1 | On | On | None | None | None | None |
| | 2 | On | Off | | | | |
| 5 | 1 | On | Off | Advanced | N/A | 0.92 | 0.93 |
| | 2 | On | On | 7° | | | |
| | 1 | On | Off | Advanced | N/A | 1.3 | 0.93 |
| | 2 | On | On | 15° | | | |
| 6 | Standard engine | — | — | 0.85 | 0.86 | 0.84 | 0.75 |

The efficiency of the engine is compared here and shown to have an increase over standard engines. While fuel to both cylinders increases power, this would not result in a greater efficiency, as shown above in Table 3. Accordingly, where power is needed, or for starting, for example, fuel may be injected into both cylinders, thus the first cylinder 24 possesses a fuel injector 40.

Accordingly, a particular feature of the invention is that a replacement head and replacement connecting rod, and camshaft are relatively inexpensive to manufacture and can be modified on an existing engine to create a modified paired cylinder engine as described in the various embodiments herein. Accordingly, a further embodiment of the invention is a kit or a system comprising a modified head having disposed openings that are situated between a pair of cylinders, and further comprising one or more replacement connecting rods to augment the angle of at least one piston in the engine, so as to pair the cylinders and create an offset angle of between 8 and 12 degrees between the paired cylinders, and a camshaft enabling an offset of between 4 and 6 degrees, corresponding to one half of the offset of the crankshaft. The result of the system is a kit that can be utilized with a standard engine to modify it to having paired cylinders. No other similar system or kit currently exists.

Although the present invention has been described in considerable detail, those skilled in the art will appreciate that numerous changes and modifications may be made to the embodiments and preferred embodiments of the invention and that such changes and modifications may be made without departing from the spirit of the invention. It is therefore intended that the appended claims cover all equivalent variations as fall within the scope of the invention.

What is claimed is:

1. An internal combustion engine comprising at least two pairs of cylinders, an equal number of pistons as they are cylinders, a first and second connecting rod, a crankshaft, a camshaft, at least two exhaust valves, at least two intake valves, at least one spark plug, and a fuel injection component:

in a first cylinder pair, a cylinder head connecting a first leading cylinder and a first trailing cylinder and having fluid passage between one another in a head opening, a first piston within said first leading cylinder and a second piston with said first trailing cylinder;

wherein the first leading cylinder and said first trailing cylinder communicate via the head opening space defined between the cylinder and the cylinder head;

wherein the head opening remains open to the first and second cylinders at all times;

wherein the second piston is a trailing piston and offset in the second cylinder by between an 8 and 12 degree crank angle from said first piston; and wherein the camshaft is engaged to the at least two exhaust valves and at least two intake valves, and said camshaft is offset by one half of the crank angle between the first and second pistons.

2. The internal combustion engine of claim 1, wherein the fuel injection component injects fuel only to the trailing cylinder, when the engine is operating at between 3500 and 5000 revolutions per minute.

3. The internal combustion engine of claim 1, wherein the offset angle of the crankshaft is 12 degrees and the offset angle of the camshaft is 6 degrees.

4. The internal combustion engine of claim 1, wherein the offset angle of the crankshaft is 8 degrees and the offset angle of the camshaft is 4 degrees.

5. The internal combustion engine of claim 1, wherein combustion occurs via ignition combustion.

6. The internal combustion engine of claim 1, wherein combustion occurs via compression combustion.

7. The internal combustion engine of claim 1, wherein ignition is provided to both the first and second cylinder.

8. The internal combustion engine of claim 1, wherein ignition is provided to only the second cylinder.

9. The internal combustion engine of claim 1, wherein ignition occurs when the first piston is at top dead center.

10. The internal combustion engine of claim 1, wherein ignition occurs when the first piston is after top dead center.

11. The internal combustion engine of claim 1, wherein the exhaust fuel to air ratio is greater than 17:1 between 3500 and 5000 RPM.

12. A method of modifying a conventional engine comprising the following steps:

a. modifying or replacing a cylinder head, to allow for at least a first leading cylinder and a second trailing cylinder to communicate by connecting the cylinders via an opening defined between the top of the first leading cylinder and the second trailing cylinder and below the cylinder head;

b. modifying or replacing a crankshaft of said engine such that at least a connecting rod, connected to said crankshaft, is connected to a first piston in said first leading cylinder, and at least a second trailing piston that is disposed of in said trailing cylinder and, wherein said second trailing piston is offset from said leading cylinder by an offset angle of between about 8 to about 12 degrees;

c. modifying or replacing at least one camshaft having an offset of one half of the offset of the crankshaft, such that the offset of the camshaft for the second trailing cylinder is one half of the offset of the crankshaft; and d. generating a modified fuel injection program engaged to at least one fuel injector, wherein fuel is disposed of only in said trailing cylinder while the engine is running at between 3500 and 5000 RPM and wherein the exhaust fuel to air ratio is greater than 17:1 at between 3500 and 5000 RPM.

13. The method of claim 12 wherein said offset angle of the crankshaft is 12 degrees.

14. The method of claim 12 wherein said offset angle of the crankshaft is 8 degrees.

15. A method of increasing the efficiency of a four-cycle engine comprising: modifying said engine, said engine comprising a first leading cylinder and second trailing cylinder, having fluid passage between one another in a head opening defined by a cylindrical tube defined in a modified cylinder head which allows for fluid and gas communication between the first leading cylinder and the second trailing cylinder, a first and second piston, a first and second connecting rod, a crankshaft, a camshaft, at least two exhaust valves, at least two intake valves, at least one spark plug, and a fuel injection component;

wherein the first and second cylinder communicate said fluid passage within the cylindrical tube between the first and second cylinder;

wherein the head opening remains open to the first and second cylinders at all times;

wherein the second piston is a trailing piston and offset in the second cylinder by between 8 and 12 degree crank angle as compared to the first piston;

wherein the camshaft is engaged to the at least two exhaust valves and at least two intake valves, and said camshaft is offset by one half of the crank angle of the crankshaft, generating one half of the offset of the crankshaft for the camshaft within the second cylinder; and injecting fuel into said second cylinder wherein fuel is provided only to the trailing cylinder when said engine is rotating at between 3500 and 5000 revolutions per minute and comprising an exhaust fuel to air ratio of greater than 17:1; and wherein a sparkplug is igniting in both the first and second cylinders despite fuel being provided only into said second cylinder.

16. The method of claim 15 wherein said offset angle of said crankshaft is 12 degrees.

17. The method of claim 15 wherein said offset angle of said crankshaft is 8 degrees.

* * * * *